US005797736A

United States Patent [19]

Mengüc et al.

[11] Patent Number: 5,797,736

[45] Date of Patent: Aug. 25, 1998

[54] RADIATION MODULATOR SYSTEM

[75] Inventors: M. Pinar Mengüc; Bruce L. Walcott; Stephen R. Swabb; Michael A. Marra, III, all of Lexington, Ky.

[73] Assignee: University of Kentucky Research Foundation, Lexington, Ky.

[21] Appl. No.: 757,695

[22] Filed: Dec. 3, 1996

[51] Int. Cl.[6] ..... F23N 5/00

[52] U.S. Cl. ..... 431/75; 431/2; 431/18; 110/185

[58] Field of Search ..... 431/2, 18, 75, 431/79; 110/185, 341, 346, 347

[56] References Cited

U.S. PATENT DOCUMENTS

| | | |
|---|---|---|
| 3,563,188 | 2/1971 | Prosser . |
| 3,590,255 | 6/1971 | Smith, Jr. et al. . |
| 3,771,731 | 11/1973 | Dyner et al. . |
| 3,865,098 | 2/1975 | Cutler . |
| 4,043,742 | 8/1977 | Egan et al. . |
| 4,059,385 | 11/1977 | Gulitz et al. . |
| 4,440,509 | 4/1984 | Agarwal . |
| 4,667,607 | 5/1987 | Fleming . |
| 4,712,888 | 12/1987 | Brooks . |
| 4,816,694 | 3/1989 | Kuppenheimer, Jr. et al. . |
| 4,942,832 | 7/1990 | Finke . |
| 5,040,859 | 8/1991 | White . |
| 5,049,063 | 9/1991 | Kishida et al. . |
| 5,249,954 | 10/1993 | Allen et al. . |
| 5,465,219 | 11/1995 | Jeffers . |
| 5,474,517 | 12/1995 | Falk et al. . |

FOREIGN PATENT DOCUMENTS

| | | | |
|---|---|---|---|
| 584317 | 2/1925 | France | 431/353 |

OTHER PUBLICATIONS

Manickavasagam et al.; Scattering Matrix Elements of Fractal Like Soot Agglomerates; Applied Optics; vol. 36, No. 6; Feb. 20, 1997.

Mengüc, et al.; Scattering Tomography and its Application to Sooting Diffusion Flames; Trans. of the ASME; vol. 16; 144–151.

Marra, M.A.; Stability and Optimality in Genetic Algrothm Controllers; Proceedings of the 1996 IEEE Inter. Symposium on Intelligent Control; Sep. 15–18; 1996; 492–496.

Marra, M.A.; Genetic Control of a Ball–Beam System; Proc. of the 1996 IEEE International Conference on Control Appl.; Sep. 15–18; 1996; 608–613.

*Primary Examiner*—Carl D. Price
*Attorney, Agent, or Firm*—King and Schickli

[57] ABSTRACT

A radiation modulator system and related method for actively controlling a flame in a combustion system are provided. The system includes a plurality of radiation modulators positioned adjacent the flame. A sensor arrangement is provided for sensing combustion characteristics of the flame and generating a sensor signal representative of the combustion characteristics. The sensor signal is received in a computer which then generates a control signal for transmission to a linkage arrangement which provides for the repositioning of the radiation modulators. Thus, the flame is actively controlled by continually repositioning the modulators in response to the sensor signal and the control signal. The related method broadly includes the steps of: (1) positioning the radiation modulators adjacent the flame; (2) sensing combustion characteristics of the flame; and (3) repositioning the radiation modulators responsive to the combustion characteristics.

7 Claims, 2 Drawing Sheets

COMPUTER
26
18
DRIVE UNIT
28
DRIVE UNIT
30
SENSOR BOX
24
10
20
30
22
14
12
14

RADIATION MODULATOR SYSTEM

TECHNICAL FIELD

The present invention relates generally to a radiation modulator system, and, more particularly, to a system and method for actively controlling a flame in a combustion system.

BACKGROUND OF THE INVENTION

Today, the majority of energy produced in the world is based on the combustion of hydrocarbon fuels. These combustion systems are complex and dynamic and, therefore, difficult to control and understand. Thus, vast amounts of time are directed towards the effective use and the ability to control conditions existent in typical combustion systems.

One of the most complex components of any combustion system is the flame and the most important feature of the flame is the significant fluctuations in the temperature distribution. These fluctuations result from the interaction of many simultaneous physical phenomena including but not limited to fluid flow, chemical kinetics, soot formation and radiation transfer. Because of this temperature distribution, there exists within a combustion system a staggered array of hot and relatively cooler pockets in a given flame. More particularly, within these relatively cooler pockets the combustion is usually not complete, and hence more unburned carbon (soot) particles are present within these cooler pockets. This results in an increased amount of undesirable pollutants being formed and discharged from the combustion system. Further, the incomplete combustion decreases the overall operating efficiency of the combustion system unit.

U.S. Pat. No. 4,440,509 to Agarwal discloses a technique and arrangement of temperature sensors for detecting the existence of hot or cold pockets in a chemical reactor. While providing for the detection of hot and cold pockets, the Agarwal patent does not teach or suggest any means for eliminating the cold pockets so as to provide more complete combustion within the reactor.

Attempts have been made to control the flame in combustion systems. However, these attempts are usually "passive" in nature as opposed to attempting to "actively" control the flame itself. For example, U.S. Pat. No. 4,043,742 to Egan et al. sets forth a system for monitoring flame conditions and then adjusting the fuel-air ratio accordingly so as to improve the overall combustion process. Thus, the Egan et al. patent provides for "passively" controlling the flame by adjusting the parameters which initially dictate the operating conditions of the flame. These types of control techniques are only minimally effective as evidenced by the fact that the overall efficiency of, for example, coal-fired combustion systems have remained constant at approximately 35% for the past 30 years.

SUMMARY OF THE INVENTION

Accordingly, it is a primary object of the present invention to provide a system and method for actively controlling a flame in a combustion system overcoming the above-described limitations and disadvantages of the prior art.

Another object of the present invention is to provide a system and method for actively controlling a flame in a combustion system resulting in a more complete combustion process and, thus, an improved overall operating efficiency for the combustion system.

Still another object of the present invention is to provide a system and method for actively controlling a flame in a combustion system that effectively decreases the emission of pollutants, such as, soot, $NO_x$ and $SO_x$ from the combustion system.

Yet another object of the present invention is to provide a system and method for actively controlling a flame in a combustion system using radiation modulators positioned adjacent the flame for redirecting/refocusing the radiant energy from the flame back onto itself.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a radiation modulator system is provided for actively controlling a flame in a combustion system. The system includes a plurality of radiation modulators positioned adjacent the flame. Advantageously, the radiation modulators provide for selectively redirecting/refocusing the radiant energy of the flame back onto itself, in a manner that effectively allows the elimination of cold pockets which would otherwise exist in the flame as a result of the significant fluctuations of flow, temperature and species concentration distributions in the flame. Of course, elimination of the cold pockets translates into a more complete combustion process and more efficient operation.

The radiation modulator system also includes a means for sensing combustion characteristics within and proximate to the flame. The sensing means is capable of generating a sensor signal representative of the combustion characteristics. More specifically, the sensing means includes an arrangement of sensors positioned adjacent to the flame for sensing important combustion characteristics within and proximate to the flame, such as, temperature, particle concentration distribution, species concentration distribution and combinations thereof. It should be appreciated that the sensors are also capable of sensing mean and fluctuating components of temperature, velocity, soot particle concentration, $NO_x$, $SO_2$, and their respective profiles, among others. They also transfer enough information so that soot agglomerate size and structure characteristics can be determined following inverse radiation algorithms.

Additionally, as is known in the art, the sensors may be optical type sensors or any other type sensors available for use in conjunction with combustion systems. Furthermore, the sensors may be integrally formed with the radiation modulators or constructed separately for placement adjacent the flame. Regardless of the type of sensors or how they are constructed for strategic placement, it is important that the sensors be able to accurately determine local combustion characteristic values with only minimal disturbance to the flow field in and around the flame. Without having these nonintrusive sensing means, the integrity of the radiation modulator system may be compromised and inaccurate combustion characteristics may be provided.

The radiation modulator system further includes an active control means. The control means is preferably in the form of a computer or microprocessor for use in conjunction with control systems which is able to receive and process the sensor signal generated by the sensing means.

In accordance with another important aspect of the present invention, a means for repositioning the plurality of radiation modulators is provided. The repositioning means reacts in response to a control signal generated by the control means so as to optimally position/reposition the radiation modulators. Advantageously, this provides for a more complete combustion process to take place within the combustion system. More specifically, the radiation modulators are specially shaped (e.g. concave, semi-cylindrical, elliptical or spherical) for a specific flame or system so as to selectively redirect/refocus the radiant energy from the flame back onto itself, thus minimizing or eliminating the cold pockets within the flame where incomplete combustion is most likely to occur. Preferably, the repositioning means includes a mechanical linkage arrangement which may be automatically repositioned in response to the control signal.

In accordance with another aspect of the present invention, a method for actively controlling a flame in a combustion system is provided. Particularly, the method broadly includes the steps of positioning the plurality of radiation modulators adjacent the flame, sensing combustion characteristics of the flame within the combustion system, and repositioning the radiation modulators responsive to the sensed combustion characteristics. Accordingly, it should be appreciated that the steps of the present method are continually repeated so as to optimally reposition the radiation modulators in response to the combustion characteristics which may exist at any given moment. Thus, an active, real-time system of control is effectively provided for the first time.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
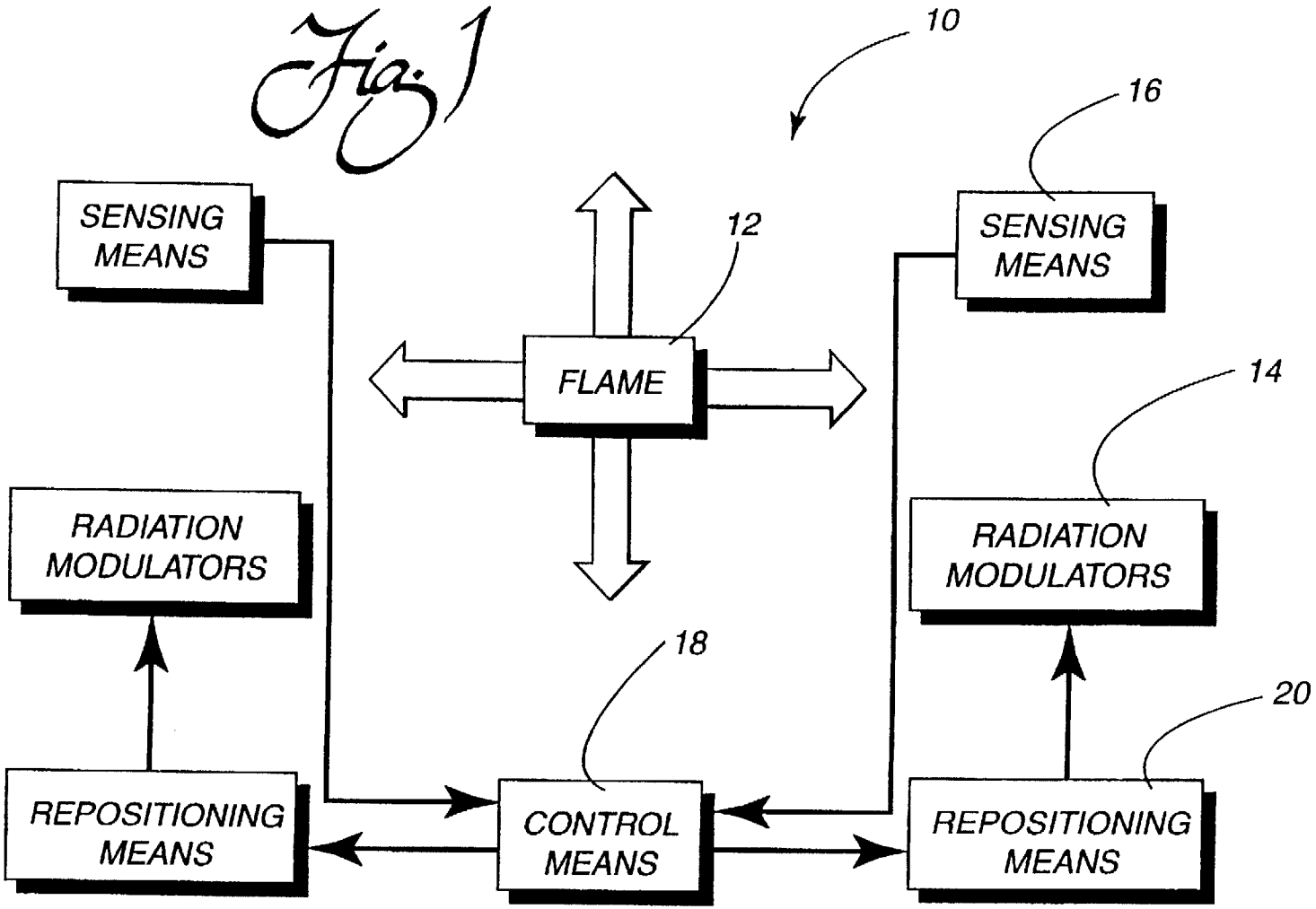
FIG. 1 is a schematical block diagram of the radiation modulator system of the present invention.

Reference is now made to FIG. 1 showing the radiation modulator system 10 of the present invention. As should be appreciated, the system 10 provides for active control of a flame 12 in a combustion system. More specifically, the ability to actively control the flame 12 allows for improving the performance of fuel oil, pulverized coal/char, or any similar fossil fuel-fired flames present in a typical combustion system. Furthermore, the system 10 may be used in conjunction with internal combustion engines, i.e. spark ignition and compression ignition engines, for improving performance. Advantageously, this results in increasing the overall operating efficiency of a combustion system, as well as, decreasing emission of pollutants, such as, soot, $NO_x$, and $SO_x$.

As further shown in FIG. 1, the system 10 for actively controlling the flame 12 includes radiation modulators 14 which are positioned adjacent the flame for selectively redirecting/refocusing the radiant energy of the flame back onto itself. A sensing means 16 is also provided for sensing combustion characteristics in and proximate to the flame 12. The sensing means 16 generates a sensor signal representative of the combustion characteristics and transmits this information to a control means 18. The control means 18 then generates a control signal which is transmitted to a repositioning means 20. More specifically, the repositioning means 20 acts in response to the control signal and adjusts the positioning of the radiation modulators 14 accordingly. As can be appreciated, the system 10 provides for active control of the flame 12 by constantly sensing the combustion characteristics and repositioning the radiation modulators 14 in response to the combustion characteristics in order to direct and/or focus radiant energy from the flame back toward relatively cool spots and pockets thereby reducing or eliminating those cool spots and pockets and providing for a more complete combustion process.

As already noted, the effective use and control of typical combustion system flames is difficult due to several complicated phenomena which occur simultaneously within the flames. Additionally, technology enabling the modeling of these phenomena is quite limited in scope and is not expected to change in the near future. Thus, a fully descriptive dynamic model of a full scale turbulent flame is well beyond the capabilities of present state of the art combustion technology. It should therefore be appreciated that the present method of actively controlling a flame 12 in a combustion system is a significant achievement in combustion technology.

More specifically, one of the most important features of a turbulent flame 12 in a combustion system is the significant fluctuations in its temperature distribution which result from the interaction of the many simultaneous physical phenomena, such as, for example, fluid flow, chemical kinetics, soot formation and convection and radiation transfer. As a result of the fluctuations of flow, temperature and concentration profiles in turbulent flames, there exists within a flame 12 a staggered array of hot and relatively cool pockets. Within these cool pockets the combustion is usually not complete and, hence more unburned soot particles are present. This results in incomplete combustion which lowers the efficiency of the combustion system, while at the same time increases the formation of pollutants.

Accordingly, it can be appreciated that the ability to actively control the flame 12 by redirecting/refocusing the energy from the flame back onto these relatively cool pockets, is a significant achievement. The radiation modulator system 10 of the present invention provides the capability for actively controlling the flame 12 in a combustion system and thereby, yielding a decrease in the emission of pollutants while increasing the efficiency of the combustion system.

Figure 2:
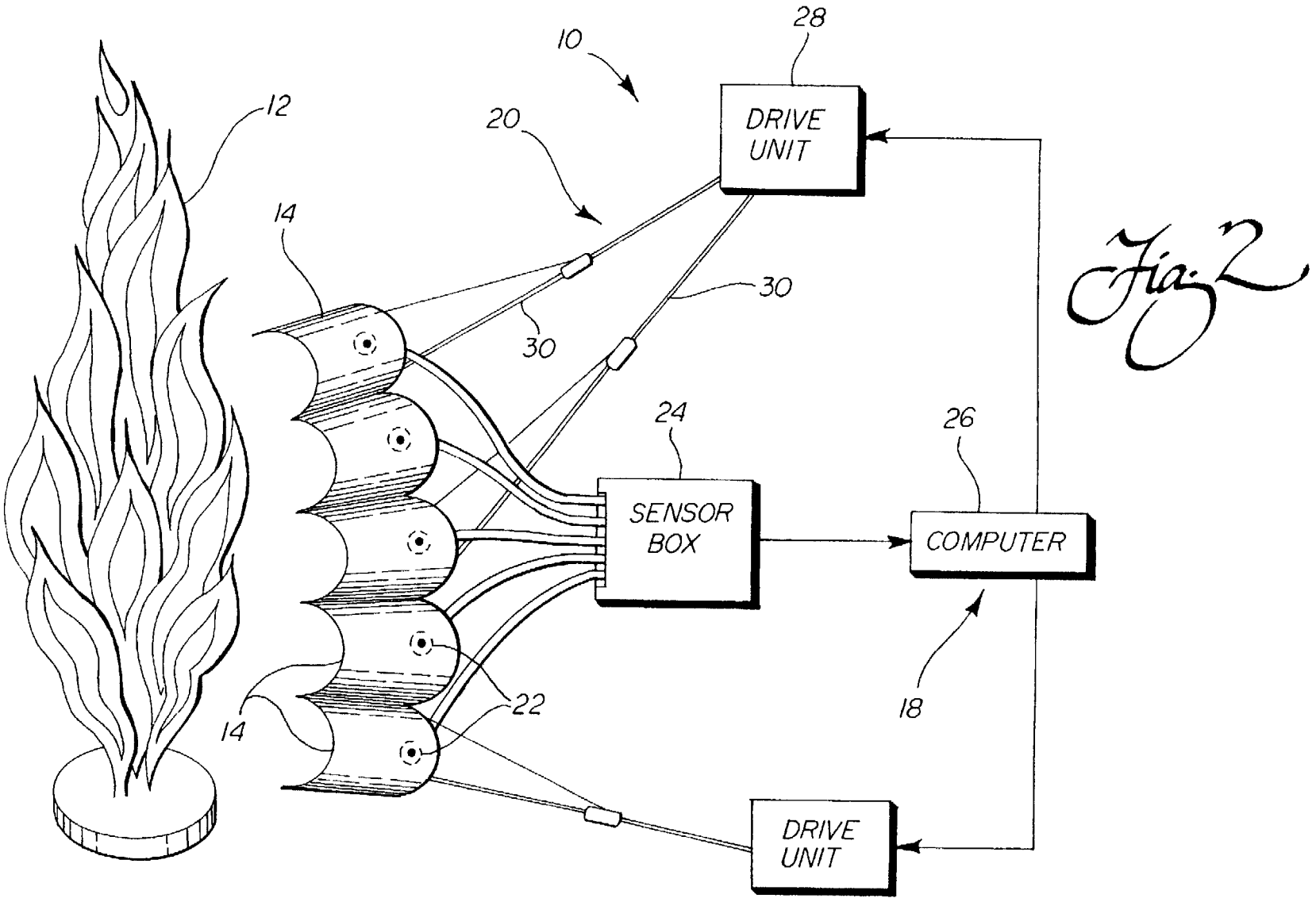
FIG. 2 is a further schematical representation of the radiation modulator system including the radiation modulators.

As best shown in FIG. 2, a plurality of radiation modulators 14 are provided for selectively redirecting/refocusing the radiant energy from the flame 12 back onto itself. More particularly, the modulators 14 are employed to enhance the radiative source distribution in combustion systems selectively in space. The modification of this distribution influences the local temperature distribution within the flame 12 which, in turn affects the chemistry and pollutant formation mechanisms.

The radiation modulators 14 are preferably positioned adjacent the flame 12. The positioning of the modulators 14 combined with the particular shape of the modulators is what makes the modulators effective in actively controlling the flame 12. The modulators 14, as shown in FIG. 2, have a concave or semi-cylindrical shape, however, it should be appreciated that the modulators may be formed in other shapes, such as, for example, elliptical, spherical or as a combination of a number of flat surfaces. The particular shape chosen for the modulators 14 is ultimately dependent upon the type of combustion system and the parameters present within the combustion system for which the system 10 is to be employed. Other characteristics or shapes of the modulators 14 which may be chosen depending upon the particular application of the modulators include, for example, solid modulators, modulators which are porous, corrugated or perforated, or staggered modulators.

Similar to the shape of the modulators 14, the material from which the modulators are constructed is an important factor to be considered. The material chosen is also dependent upon the type of combustion system with which the system 10 is to be used. The modulators 14 may, for example, be constructed of metal, special alloy material or ceramic materials which are capable of withstanding the extreme temperatures present in a particular combustion system.

As described above, the modulators 14 are initially positioned adjacent to the flame 12. However, the turbulent conditions present within the flame necessitate that a dynamic radiation modulator system 10 be provided for actively controlling the flame 12. Thus, in accordance with an important aspect of the present invention, the modulators 14 are capable of being repositioned so as to accommodate the constantly changing conditions which exist within the combustion system, and more particularly, within and proximate to the flame 12. Specifically, the present invention advantageously provides for repositioning the modulators 14 both spatially (in Cartesian, cylindrical, or spherical coordinates) and angularly (with polar and azimuthal angles). The modulators 14 are therefore capable of being positioned or repositioned responsive to the flame combustion characteristics so that the radiant energy may be effectively redirected/refocused back onto the flame 12, toward any cold spots or pockets that develop, as needed. The means employed for repositioning the modulators 14 is described in more detail below.

In order to effectively reposition the radiation modulators 14 so as to actively control the flame 12, the present invention further includes a sensing means 16 for sensing combustion characteristics of the flame. As best shown in FIG. 2, the sensing means 16 includes a plurality of sensors 22, positioned adjacent to the flame 12, and a sensor box 24. Further, the sensing means 16 is capable of generating a sensor signal representative of the combustion characteristics. While the sensors 22 shown in FIG. 2 are integrally formed with the modulators 14, it should be appreciated that the sensors may also be formed separately and positioned adjacent to the flame 12 for sensing the combustion characteristics data.

The sensors 22 may be, for example, optical sensors which are suitable for use in conjunction with combustion systems, as is known in the art. These optical sensors may include photomultiplier tubes, semiconductor based detectors as well as charge-coupled device (CCD) arrays, and may be used in conjunction with fiber-optic cables, which transfer flame radiation or transmitted light/laser beam to the detectors. These detectors and fiber optic cables can be purchased from a number of vendors, including Oriel, Hamamatsu, Newport and Ealing, among others. In addition, as is known, other types of sensors, available for use in conjunction with combustion system flames, may be used with the present invention. For example, a summary of sensors available for use in particle laden flames in pulverized coal fired furnaces is set forth in Elliot, T. C., "Advanced Sensors", Power, August 1994, pp. 13–25.

Regardless of the type of sensor 22 which is selected for use, the sensor should be capable of sensing combustion characteristics that are most essential to achieving the goal of actively controlling the flame 12. As described above, significant fluctuations in temperature distribution in and proximate to the flame 12 is the primary reason that hot and relatively cold pockets exist within the flame. Thus, the sensors 22 must be able to sense the physical phenomena which interact to create the fluctuations in temperature distribution, such as, temperature, particle concentration distribution, species concentration distribution and combinations thereof. In addition, it should be appreciated that the sensors 22 should also be capable of sensing a number of other standard measurements, such as, mean and fluctuating components of temperature, velocity, species (including soot, $NO_x$, $SO_2$) concentration profiles, line-of-sight flame emission, as well as transmission of light/laser beams which prorogate through the flame (if used). This additional information allows construction of temperature and species concentration distributions within the flame in real time, which prompts the control system to align/direct the radiation modulators towards the specific regions of the flame.

Furthermore, it is important that the sensors be able to accurately determine local combustion characteristic values with only minimal disturbance to the flow field in and around the flame 12. Otherwise, the integrity of the radiation modulator system may be compromised if inaccurate combustion characteristics are provided by the sensing means 16.

The sensor signal, which is representative of the combustion characteristics, is generated by the sensing means 16 and then transmitted to a control means 18. As shown in FIG. 2, the control means 18 is preferably in the form of a dedicated mircocontroller or even a (personal) computer 26 operated under the control of appropriate software such as the newly developed and copyrighted control software entitled GAdaptware Version 1.0. Of course, other appropriate software may be utilized.

In addition, it should be appreciated that the control means 18 may employ an intelligent control methodology for optimizing the position and orientation of the radiation modulators 14. The intelligent control methodology may consist of, for example, neural networks, genetic algorithms or fuzzy logic control algorithms. However, the present invention may include any type feedback control means for positioning/repositioning the modulators.

The control means 18, or more particularly the computer 26, is preferably capable of generating a control signal and transmitting the control signal to the repositioning means 20. The repositioning means 20 reacts in response to the control signal so as to optimally reposition the radiation modulators 14 to achieve the most complete combustion possible. More particularly, the modulators 14 are repositioned so as to redirect/refocus the radiant energy from the flame 12 back onto itself. Specifically, the radiant energy is redirected/refocused so as to eliminate the relatively cold pockets which exist in the flame 12.

As shown in FIG. 2, the repositioning means 20 includes a drive unit 28 for receiving the control signal and operating the linkage arrangements 30 which are operatively connected to the radiation modulators 14. The linkage arrangements 30 provide for repositioning the radiation modulators 14 both spatially and angularly, as described above. The linkage arrangements 30 may be of any type mechanical linkage system as is known in the art which are capable of providing the repositioning capabilities for use in conjunction with the present system 10. Such a linkage arrangement may be built in house for a particular application, or its components can be purchased from different vendors.

More specifically describing the repositioning means 20, the drive unit 28 may be of any type controller mechanism as is known. For example, drive unit 28 may be a series of cooperating stepper motors, linkages and various kinematic mechanisms. The exact type of the repositioning means depends on the particular application and available physical space around the flame. It is appreciated that a system used in a large scale coal-fired system is going to be different from that used in an internal combustion engine.

In operation, the method for actively controlling the flame 12 of a combustion system utilizing the radiation modulator system 10 described above includes the initial step of positioning a plurality of radiation modulators 14 adjacent the flame. The exact positioning of the modulators 14 depends on the type of combustion system and the operating parameters therein. The important factor, however, is that the modulators 14 be positioned so as to most effectively redirect/refocus the radiant energy back onto the flame 12.

The method next includes sensing the combustion characteristics of the flame 12 utilizing sensing means 16 and generating a sensor signal representative of the combustion characteristics. The sensor signal is received by the control means 18 which in turn generates a control signal. The control signal is then received by the repositioning means 20 which operates to reposition the modulators 14 accordingly.

In summary, numerous benefits have been described which result from employing the concepts of the present invention. Advantageously, the system 10 and the method of the present invention provide for actively controlling a combustion system flame 12. The ability to actively control a flame having turbulent and dynamic conditions is a significant achievement in combustion system technology. The active control of the flame results in a more complete combustion process taking place. Advantageously, this results in increasing the performance of the combustion system while at the same time decreasing the emission of pollutants from the combustion system.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A method for increasing combustion efficiency and reducing pollutants produced by a flame, comprising:

sensing cooler spots in said flame; and reflecting and focusing radiant energy from said flame into said cooler spots sensed in said flame.

2. A method for actively controlling a flame in a combustion system comprising the steps:

positioning a radiation modulator adjacent said flame;

sensing combustion characteristics of said flame within said combustion system; and repositioning said radiation modulator responsive to said combustion characteristics in order to focus reflected radiant energy onto relatively cooler spots sensed in said flame.

3. A radiation modulator system for actively controlling a flame in a combustion system, comprising:

a radiation modulator positioned adjacent said flame;

means for sensing combustion characteristics, said sensing means generating a sensor signal representative of said combustion characteristics;

control means for receiving said sensor signal and generating a control signal; and means for repositioning said radiation modulator in response to said control signal, whereby said flame is actively controlled by repositioning said radiation modulator in response to said sensor signal and said control signal.

4. The radiation modulator system set forth in claim 3, wherein said radiation modulator is concave for selectively refocusing radiant energy from said flame back onto a relatively cool spot sensed in said flame.

5. The radiation modulator system set forth in claim 3, wherein said sensing means includes a plurality of optical sensors for sensing said combustion characteristics.

6. The radiation modulator system set forth in claim 5, wherein said optical sensors are integrally formed with said radiation modulator.

7. The radiation modulator system set forth in claim 5, wherein said optical sensors are positioned adjacent said flame.

* * * * *